US007741257B2

(12) United States Patent
Valencia Sil et al.

(10) Patent No.: US 7,741,257 B2
(45) Date of Patent: Jun. 22, 2010

(54) DRY LUBRICANT FOR CONVEYING CONTAINERS

(75) Inventors: Arturo S. Valencia Sil, Naucalpan (MX); Lawrence A. Grab, Dusseldorf (DE); Bruce E. Schmidt, Apple Valley, MN (US); David A. Halsrud, Minneapolis, MN (US); Guang-Jong Jason Wei, Mendota Heights, MN (US); Eric D. Morrison, West Saint Paul, MN (US); Hector R. DiBenedetto, Pilar (AR)

(73) Assignee: Ecolab Inc., St. Paul, MN (US)

( * ) Notice: Subject to any disclaimer, the term of this patent is extended or adjusted under 35 U.S.C. 154(b) by 975 days.

(21) Appl. No.: 11/080,000

(22) Filed: Mar. 15, 2005

(65) Prior Publication Data

US 2006/0211583 A1 Sep. 21, 2006

(51) Int. Cl.
*C10M 139/04* (2006.01)

(52) U.S. Cl. ..... 508/212; 508/202; 508/208; 508/209; 508/215; 508/421; 508/459; 508/522; 508/545

(58) Field of Classification Search ..... 508/215, 508/421, 459
See application file for complete search history.

(56) References Cited

U.S. PATENT DOCUMENTS 3,011,975 A 12/1961 Nitzsche et al.
3,213,024 A 10/1965 Blake et al.
3,514,314 A 5/1970 Nemeth et al.
3,664,956 A 5/1972 Messina et al.
3,853,607 A 12/1974 Iyengar et al.
3,981,812 A 9/1976 Zietz
4,062,785 A 12/1977 Nibert
4,065,590 A 12/1977 Salensky
4,069,933 A 1/1978 Newing
4,083,791 A 4/1978 Elliott
4,105,716 A 8/1978 Sakai et al.
4,132,657 A 1/1979 Verdicchio
4,149,624 A 4/1979 Douty et al.
4,162,347 A 7/1979 Montgomery
4,165,291 A 8/1979 Gragson
4,225,450 A 9/1980 Rosenberger
4,248,724 A 2/1981 MacIntosh
4,252,528 A 2/1981 Decker et al.
4,262,776 A 4/1981 Wilson et al.
4,264,650 A 4/1981 Schulze et al.
4,274,973 A 6/1981 Stanton et al.
4,289,671 A 9/1981 Hernandez
4,324,671 A 4/1982 Christian et al.
4,343,616 A 8/1982 Decker et al.
4,375,444 A 3/1983 Deeken
4,420,578 A 12/1983 Hagens et al.
4,436,200 A 3/1984 Hodlewski et al.
4,478,889 A 10/1984 Maruhashi et al.
4,486,378 A 12/1984 Hirata et al.
4,515,836 A 5/1985 Cobbs, Jr. et al.
4,525,377 A 6/1985 Nickel et al.
4,534,995 A 8/1985 Pocock et al.
4,538,542 A 9/1985 Kennon et al.
4,543,909 A 10/1985 Sharpless
4,555,543 A 11/1985 Effenberger et al.
4,569,869 A 2/1986 Kushida et al.
4,573,429 A 3/1986 Cobbs, Jr. et al.
4,604,220 A 8/1986 Stanton
4,632,053 A 12/1986 Villanueva et al.
4,690,299 A 9/1987 Cannon
4,699,809 A 10/1987 Maruhashi et al.
4,713,266 A 12/1987 Hasegawa et al.
4,714,580 A 12/1987 Maruhashi et al.
4,719,022 A 1/1988 Hyde
4,769,162 A 9/1988 Remus
4,828,727 A 5/1989 McAninch
4,851,287 A 7/1989 Hartsing, Jr.
4,855,162 A 8/1989 Wrasidlo et al.
4,867,890 A 9/1989 Colclough
4,874,647 A 10/1989 Yatsu et al.
4,919,984 A 4/1990 Maruhashi et al.
4,929,375 A 5/1990 Rossio et al.
4,980,211 A 12/1990 Kushida et al.

(Continued)

FOREIGN PATENT DOCUMENTS

CA 1157456 11/1983

(Continued)

OTHER PUBLICATIONS

U.S. Appl. No. 09/619,261, filed Jul. 19, 2000, Corby.

(Continued)

*Primary Examiner*—Glenn A Caldarola
*Assistant Examiner*—Taiwo Oladapo
(74) *Attorney, Agent, or Firm*—Merchant & Gould

(57) ABSTRACT

The passage of a container along a conveyor is lubricated by applying to the container or conveyor a mixture of a water-miscible silicone material and a water-miscible lubricant. The mixture can be applied in relatively low amounts, to provide thin, substantially non-dripping lubricating films. In contrast to dilute aqueous lubricants, the lubricants of the invention provide drier lubrication of the conveyors and containers, a cleaner conveyor line and reduced lubricant usage, thereby reducing waste, cleanup and disposal problems.

41 Claims, No Drawings

U.S. PATENT DOCUMENTS

| | | | | |
|---|---|---|---|---|
| 4,995,993 | A | 2/1991 | Papke | |
| 5,001,935 | A | 3/1991 | Tekkanat et al. | |
| 5,009,801 | A | 4/1991 | Wider et al. | |
| 5,032,301 | A | 7/1991 | Pawloski | |
| 5,073,280 | A | 12/1991 | Rossio et al. | |
| 5,104,559 | A | 4/1992 | Pawloski | |
| 5,115,047 | A | 5/1992 | Hashimoto et al. | |
| 5,145,721 | A | 9/1992 | Kojima et al. | |
| 5,160,646 | A | 11/1992 | Scheld | |
| 5,174,914 | A | 12/1992 | Gutzmann | |
| 5,182,035 | A | 1/1993 | Schmidt et al. | |
| 5,202,037 | A | 4/1993 | Lavelle et al. | |
| 5,238,718 | A | 8/1993 | Yano et al. | |
| 5,244,589 | A | 9/1993 | Liu et al. | |
| 5,317,061 | A | 5/1994 | Chu et al. | |
| 5,334,322 | A | 8/1994 | Williams, Jr. | |
| RE34,742 | E | 9/1994 | Maier et al. | |
| 5,352,376 | A | 10/1994 | Gutzmann | |
| 5,371,112 | A | 12/1994 | Sayre et al. | |
| 5,391,308 | A | 2/1995 | Despo | |
| 5,411,672 | A | 5/1995 | Kagaya | |
| 5,509,965 | A | 4/1996 | Harry et al. | |
| 5,510,045 | A | 4/1996 | Remus | |
| 5,559,087 | A | 9/1996 | Halsrud | |
| 5,565,127 | A | 10/1996 | Laufenberg et al. | |
| 5,573,819 | A | 11/1996 | Nugent, Jr. et al. | |
| 5,652,034 | A | 7/1997 | Seiner | |
| 5,658,619 | A | 8/1997 | Kirschner et al. | |
| 5,663,131 | A | 9/1997 | Winicov et al. | |
| 5,670,463 | A | 9/1997 | Maples | |
| 5,672,401 | A | 9/1997 | Anglin et al. | |
| 5,681,628 | A | 10/1997 | Niederst et al. | |
| 5,698,269 | A | 12/1997 | Carlblom et al. | |
| 5,721,023 | A | 2/1998 | Ostapchenko | |
| 5,723,418 | A | 3/1998 | Person Hei et al. | |
| 5,728,770 | A | 3/1998 | Yamamoto et al. | |
| 5,747,431 | A | 5/1998 | Taylour et al. | |
| 5,783,303 | A | 7/1998 | Tsuei | |
| 5,789,459 | A | 8/1998 | Inagaki et al. | |
| 5,863,874 | A | 1/1999 | Person Hei et al. | |
| 5,871,590 | A | 2/1999 | Hei et al. | |
| 5,876,812 | A | 3/1999 | Frisk et al. | |
| 5,925,601 | A | 7/1999 | McSherry et al. | |
| 5,932,526 | A | 8/1999 | Person Hei | |
| 5,935,914 | A | 8/1999 | Theyssen et al. | |
| 5,952,601 | A | 9/1999 | Sanford et al. | |
| 6,060,444 | A | 5/2000 | Schulz et al. | |
| 6,087,308 | A | 7/2000 | Butler et al. | |
| 6,096,692 | A | 8/2000 | Hagihara | |
| 6,207,622 | B1 | 3/2001 | Li | |
| 6,214,777 | B1 * | 4/2001 | Li et al. | 508/388 |
| 6,288,012 | B1 | 9/2001 | Li | |
| 6,372,698 | B1 | 4/2002 | Strothoff | |
| 6,427,826 | B1 | 8/2002 | Li | |
| 6,495,494 | B1 | 12/2002 | Li | |
| 6,509,302 | B2 | 1/2003 | Li | |
| 6,541,430 | B1 | 4/2003 | Beatty | |
| 6,569,816 | B2 | 5/2003 | Oohira | |
| 6,576,298 | B2 | 6/2003 | Bennett | |
| 6,653,263 | B1 | 11/2003 | Küpper et al. | |
| 6,673,753 | B2 | 1/2004 | Person Hei | |
| 6,677,280 | B2 | 1/2004 | Küpper et al. | |
| 6,688,434 | B2 | 2/2004 | Johnson et al. | |
| 6,696,394 | B1 | 2/2004 | Ruhr | |
| 6,743,758 | B2 | 6/2004 | Li | |
| 6,780,823 | B2 | 8/2004 | Li | |
| 6,806,240 | B1 | 10/2004 | Hei et al. | |
| 6,809,068 | B1 | 10/2004 | Küpper | |
| 6,821,568 | B2 | 11/2004 | Bennett et al. | |
| 6,855,676 | B2 | 2/2005 | Li | |
| 2003/0073589 | A1 | 4/2003 | Li | |
| 2003/0207040 | A1 * | 11/2003 | Bennett et al. | 427/421 |
| 2004/0029741 | A1 | 2/2004 | Corby | |
| 2004/0058829 | A1 | 3/2004 | Hei | |
| 2004/0097382 | A1 | 5/2004 | Li | |
| 2004/0102337 | A1 | 5/2004 | Li | |
| 2004/0235680 | A1 | 11/2004 | Lawrence | |

FOREIGN PATENT DOCUMENTS

| | | |
|---|---|---|
| DE | 19942535 | 3/2001 |
| EP | 0359330 | 3/1990 |
| EP | 0844299 | 5/1998 |
| GB | 1564128 | 4/1980 |
| JP | 57003892 | 1/1982 |
| JP | 6136377 | 5/1994 |
| JP | 7247293 | 9/1995 |
| JP | 7268380 | 10/1995 |
| JP | 10053679 | 2/1998 |
| JP | 10059523 | 3/1998 |
| JP | 2004217866 | 8/2004 |
| NL | 9300742 | 12/1993 |
| WO | WO96/08601 | 3/1996 |
| WO | WO98/51746 | 11/1998 |
| WO | WO01/07544 | 2/2001 |
| WO | WO01/07554 | 2/2001 |
| WO | WO01/12759 | 2/2001 |
| WO | WO02/20381 | 3/2002 |
| WO | WO03078557 | 9/2003 |
| WO | WO2006/009421 | 1/2006 |
| WO | WO2007/040677 | 4/2007 |
| WO | WO2007/040678 | 4/2007 |

OTHER PUBLICATIONS

U.S. Appl. No. 11/233,596, filed Sep. 22, 2005, Morrison.

*Dow Corning Emulsion* [*Online*] *1998, XP002463027*, URL: http://www2.dowcorning.com/DataFiles/090007c880001bdc.pdf, Dec. 19, 2007, 2 pages.

Gilbert, Peter, "*Conveyor Lubrication in Dairies, Breweries and Beverage Plants*", Klensan (Pty) Ltd., S.A. Food Review—Dec. 1981/Jan. 1982, pp. 27-28, 2 pages.

Gorton, Hugh J. Ph.D. and Taylour, Jim M. PhD. C Chem, "*The Development of New Conveyor Lubricant Technology*", MBAA Technical Quarterly, vol. 30, pp. 18-22, 1993, 5 pages.

U.S. Appl. No. 60/149,048, filed Aug. 16, 1999, Hei et al.

U.S. Appl. No. 60/149,095, filed Aug. 16, 1999, Hei et al.

U.S. Appl. No. 60/230,662, filed Sep. 7, 2000, Bennett.

International Search Report of EP03076178 dated Jun. 12, 2003, 2 pgs.

European Search Report of EP03076177 dated Jul. 17, 2003, 2 pgs.

Dupont, "Krytox® Dry Film Lubricants", Nov. 1997, 6 pgs.

Ecolab, "Lube Application to Conveyor Surface/Containers", Jun. 13, 2000, 7 pgs.

Interflon, "Fin Food Lube AL. High Penetration Teflon® Lubricating Agent Especially Suitable for Automatic Lubrication Systems for the Food Processing Industry", 1998, 20 pgs.

Interflon, "Maintenance Products with Teflon®", http://www.interflon.nl/engels.htm, Jun. 18, 1999, 10 pgs.

Moskala, E., "Environmental Stress Cracking in PET Beverage Containers", Bev-Pak Americas '96, Apr. 15-16, 1996, 14 pgs.

Moskala, E., "Environmental Stress Cracking in PET Carbonated Soft Drink Containers", Bev Tech 98, Mar. 30-Apr. 1, 1998, 22 pgs.

Synco Chemical Corporation, "Other Super Lube Products . . . What is Super Lube®?" http://www.super-lube.com, May 5, 1999, 5 pgs.

Tekkanat, B. et al., "Environmental Stress Cracking Resistance of Blow Molded Poly(Ethylene Terephthalate) Containers", Polymer Engineering and Science, vol. 32, No. 6, Mar. 1992, pp. 393-397, 5 pgs.

US 5,863,871, 01/1999, Besse et al. (withdrawn)

* cited by examiner

DRY LUBRICANT FOR CONVEYING CONTAINERS

FIELD OF THE INVENTION

This invention relates to conveyor lubricants and to a method for conveying articles. The invention also relates to conveyor systems and containers wholly or partially coated with such lubricant compositions.

BACKGROUND

In commercial container filling or packaging operations, the containers typically are moved by a conveying system at very high rates of speed. Typically, a concentrated lubricant is diluted with water to form an aqueous dilute lubricant solution (i.e., dilution ratios of 100:1 to 500:1), and copious amounts of aqueous dilute lubricant solutions are typically applied to the conveyor or containers using spray or pumping equipment. These lubricant solutions permit high-speed operation of the conveyor and limit marring of the containers or labels, but also have some disadvantages. First, dilute aqueous lubricants typically require use of large amounts of water on the conveying line, which must then be disposed of or recycled, and which causes an unduly wet environment near the conveyor line. Second, some aqueous lubricants can promote the growth of microbes. Third, by requiring dilution of the concentrated lubricant dilution errors can occur, leading to variations and errors in concentration of the aqueous dilute lubricant solution. Finally, by requiring water from the plant, variations in the water can have negative side effects on the dilute lubrication solution. For example, alkalinity in the water can lead to environmental stress cracking in PET bottles.

When an aqueous dilute lubricant solution is used, it is typically applied at least half of the time the conveyor is running, and usually it is applied continuously. By running the aqueous dilute lubricant solution continuously, more lubricant is used than is necessary, and the lubricant concentrate drums have to be switched out more often than necessary.

"Dry lubes" have been described in the past as a solution to the disadvantages of dilute aqueous lubricants. A "dry lube" historically has referred to a lubricant composition with less than 50% water that was applied to a container or conveyor without dilution. However, this application typically required special dispensing equipment and nozzles and energized nozzles in particular. Energized nozzles refer to nozzles where the lubricant stream is broken into a spray of fine droplets by the use of energy, which may include high pressures, compressed air, or sonication to deliver the lubricant. Silicone materials have been the most popular "dry lube". However, silicone is primarily effective at lubricating plastics such as PET bottles, and has been observed to be less effective at lubricating on glass or metal containers, particularly on a metal surface. If a plant is running more than one type of container on a line, the conveyor lubricant will have to be switched before the new type of container can be run. Alternatively, if a plant is running different types of containers on different lines, the plant will have to stock more than one type of conveyor lubricant. Both scenarios are time consuming and inefficient for the plant.

It is against this background that the present invention has been made.

SUMMARY OF THE INVENTION

The present invention is generally directed to a silicone lubricant having greater than 50% water. The present invention provides, in one aspect, a method for lubricating the passage of a container along a conveyor comprising applying a mixture of a water-miscible silicone material and a water-miscible lubricant to at least a portion of the container contacting surface of the conveyor or to at least a portion of the conveyor-contacting surface of the container.

In some embodiments, the present invention is directed to a silicone lubricant having greater than 50% water that is not diluted prior to applying it to a conveyor or container surface. In some embodiments, the present invention is directed to a method of applying an undiluted lubricant intermittently. In some embodiments, the present invention is directed to a "universal" lubricant that may be used with a variety of container and conveyor materials.

In some embodiments, the water-miscible lubricant is selected from the group consisting of a fatty acid, a phosphate ester, an amine, and an amine derivative so that the composition is effective at lubricating glass and metal containers. In some embodiments, the water-miscible lubricant is a traditional glass or metal lubricant.

The present invention provides several advantages over the prior art. First, by including water in the concentrate composition, the problems associated with dilute lubricants can be avoided. For example, the composition can be applied undiluted with standard application equipment (i.e. non-energized nozzles). By including some water, the composition can be applied "neat" or undiluted upon application resulting in drier lubrication of the conveyors and containers, a cleaner and drier conveyor line and working area, and reduced lubricant usage, thereby reducing waste, cleanup and disposal problems. Further, by adding water to the composition and not requiring dilution upon application, dilution problems are avoided along with problems created by the water (i.e. microorganisms and environmental stress cracking). Intermittent application of the lubricant composition also has the advantages of reduced lubricant usage and the resulting cost savings, and decreasing the frequency that the lubricant containers have to be switched.

Finally, the present invention has the ability to provide lubrication to a variety of container and conveyor materials, giving a plant the option to run one lubricant on several lines.

DETAILED DESCRIPTION

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Compositions

As previously discussed, the present invention is generally directed to a silicone lubricant having greater than 50% water. The invention provides a lubricant coating that reduces the coefficient of friction of coated conveyor parts and containers and thereby facilitates movement of containers along a conveyor line. The present invention provides in one aspect, a method for lubricating the passage of a container along a conveyor comprising applying a mixture of a water-miscible silicone material and a water-miscible lubricant to at least a portion of the container contacting surface of the conveyor or to at least a portion of the conveyor contacting surface of the container.

In some embodiments, the present invention is directed to a silicone lubricant having greater than 50% water that is not diluted prior to applying it to a conveyor or container surface. In some embodiments, the present invention is directed to a method of applying an undiluted lubricant intermittently. In some embodiments, the present invention is directed to a "universal" lubricant that may be used with a variety of container and conveyor materials. The composition preferably can be applied while the conveyor is at rest or while it is moving, e.g., at the conveyor's normal operating speed. Preferably the lubricant coating is water-based cleaning agent-removable, that is, it preferably is sufficiently soluble or dispersible in water so that the coating can be removed from the container or conveyor using conventional aqueous cleaners, without the need for high pressure, mechanical abrasion or the use of aggressive cleaning chemicals.

The silicone material and hydrophilic lubricant are "water-miscible", that is, they are sufficiently water-soluble or water-dispersible so that when added to water at the desired use level they form a stable solution, emulsion or suspension. The desired use level will vary according to the particular conveyor or container application, and according to the type of silicone and hydrophilic lubricant employed.

A variety of water-miscible silicone materials can be employed in the lubricant compositions, including silicone emulsions (such as emulsions formed from methyl(dimethyl), higher alkyl and aryl silicones; and functionalized silicones such as chlorosilanes; amino-, methoxy-, epoxy- and vinyl-substituted siloxanes; and silanols). Suitable silicone emulsions include E2175 high viscosity polydimethylsiloxane (a 60% siloxane emulsion commercially available from Lambent Technologies, Inc.), E2140 polydimethylsiloxane (a 35% siloxane emulsion commercially available from Lambent Technologies, Inc.), E21456 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30-60% siloxane emulsion commercially available from Dow Corning Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones). Other water-miscible silicone materials include finely divided silicone powders such as the TOSPEARL™ series (commercially available from Toshiba Silicone Co. Ltd.); and silicone surfactants such as SWP30 anionic silicone surfactant, WAXWS-P nonionic silicone surfactant, QUATQ-400M cationic silicone surfactant and 703 specialty silicone surfactant (all commercially available from Lambent Technologies, Inc.). Preferred silicone emulsions typically contain from about 30 wt. % to about 70 wt. % water. Non-water-miscible silicone materials (e.g., non-water-soluble silicone fluids and non-water-dispersible silicone powders) can also be employed in the lubricant if combined with a suitable emulsifier (e.g., nonionic, anionic or cationic emulsifiers). For applications involving plastic containers (e.g., PET beverage bottles), care should be taken to avoid the use of emulsifiers or other surfactants that promote environmental stress cracking in plastic containers.

Polydimethylsiloxane emulsions are preferred silicone materials.

A variety of water-miscible lubricants can be employed in the lubricant compositions, including hydroxy-containing compounds such as polyols (e.g., glycerol and propylene glycol); polyalkylene glycols (e.g., the CARBOWAX™ series of polyethylene and methoxypolyethylene glycols, commercially available from Union Carbide Corp.); linear copolymers of ethylene and propylene oxides (e.g., UCON™ 50-HB-100 water-soluble ethylene oxide:propylene oxide copolymer, commercially available from Union Carbide Corp.); and sorbitan esters (e.g., TWEEN™ series 20, 40, 60, 80 and 85 polyoxyethylene sorbitan monooleates and SPAN™ series 20, 80, 83 and 85 sorbitan esters, commercially available from ICI Surfactants). Other suitable water-miscible lubricants include fatty acids, phosphate esters, amines and their derivatives such as amine salts and fatty amines, and other commercially available water-miscible lubricants that will be familiar to those skilled in the art. Derivatives (e.g., partial esters or ethoxylates) of the above lubricants can also be employed. For applications involving plastic containers, care should be taken to avoid the use of water-miscible lubricants that might promote environmental stress cracking in plastic containers. Preferably the water-miscible lubricant is a fatty acid, phosphate ester or amine or amine derivative. Example of suitable fatty acid lubricants include oleic acid, tall oil, $C_{10}$ to $C_{18}$ fatty acids, and coconut oil. Examples of suitable phosphate ester lubricants include polyethylene phenol ether phosphate and those phosphate esters described in U.S. Pat. No. 6,667,283, which is incorporated by reference herein in its entirety. Examples of suitable amine or amine derivative lubricants include oleyl diamino propane, coco diamino propane, lauryl propyl diamine, dimethyl lauryl amine, PEG coco amine, alkyl $C_{12}$-$C_{14}$ oxy propyl diamine, and those amine compositions described in U.S. Pat. Nos. 5,182,035 and 5,932,526, both of which are incorporated by reference herein in their entirety.

Preferred amounts for the silicone material, hydrophilic lubricant and water or hydrophilic diluent are about 0.1 to about 10 wt. % of the silicone material (exclusive of any water or other hydrophilic diluent that may be present if the silicone material is, for example, a silicone emulsion), about 0.05 to about 20 wt. % of the hydrophilic lubricant, and about 70 to about 99.9 wt. % of water or hydrophilic diluent. More preferably, the lubricant composition contains about 0.2 to about 8 wt. % of the silicone material, about 0.1 to about 15 wt. % of the hydrophilic lubricant, and about 75 to about 99 wt. % of water or hydrophilic diluent. Most preferably, the lubricant composition contains about 0.5 to about 5 wt. % of the silicone material, about 0.2 to about 10 wt. % of the hydrophilic lubricant, and about 85 to about 99 wt. % of water or hydrophilic diluent.

The lubricant compositions can contain additional components if desired. For example, the compositions can contain adjuvants such as conventional waterborne conveyor lubricants (e.g., fatty acid lubricants), antimicrobial agents, colorants, foam inhibitors or foam generators, cracking inhibitors (e.g., PET stress cracking inhibitors), viscosity modifiers, film forming materials, surfactants, antioxidants or antistatic agents. The amounts and types of such additional components will be apparent to those skilled in the art.

For applications involving plastic containers, the lubricant compositions preferably have a total alkalinity equivalent to less than about 100 ppm $CaCO_3$, more preferably less than about 50 ppm $CaCO_3$, and most preferably less than about 30 ppm $CaCO_3$, as measured in accordance with Standard Methods for the Examination of Water and Wastewater, $18^{th}$ Edition, Section 2320, Alkalinity.

A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

The lubricant composition can also be applied to a wide variety of containers including beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). The containers can have a variety of sizes and forms, including cartons (e.g., waxed cartons or TETRA-PACK™ boxes), cans, bottles and the like. Although any desired portion of the container can be coated with the lubricant composition, the lubricant composition preferably is applied only to parts of the container that will come into contact with the conveyor or with other containers. Preferably, the lubricant composition is not applied to portions of thermoplastic containers that are prone to stress cracking. In a preferred embodiment of the invention, the lubricant composition is applied to the crystalline foot portion of a blow-molded, footed PET container (or to one or more portions of a conveyor that will contact such foot portion) without applying significant quantities of lubricant composition to the amorphous center base portion of the container. Also, the lubricant composition preferably is not applied to portions of a container that might later be gripped by a user holding the container, or, if so applied, is preferably removed from such portion prior to shipment and sale of the container. For some such applications the lubricant composition preferably is applied to the conveyor rather than to the container, in order to limit the extent to which the container might later become slippery in actual use.

The lubricant composition can be a liquid or semi-solid at the time of application. Preferably the lubricant composition is a liquid having a viscosity that will permit it to be pumped and readily applied to a conveyor or containers, and that will facilitate rapid film formation whether or not the conveyor is in motion. The lubricant composition can be formulated so that it exhibits shear thinning or other pseudo-plastic behavior, manifested by a higher viscosity (e.g., non-dripping behavior) when at rest, and a much lower viscosity when subjected to shear stresses such as those provided by pumping, spraying or brushing the lubricant composition. This behavior can be brought about by, for example, including appropriate types and amounts of thixotropic fillers (e.g., treated or untreated fumed silicas) or other rheology modifiers in the lubricant composition.

Methods of Application

The lubricant coating can be applied in a constant or intermittent fashion. Preferably, the lubricant coating is applied in an intermittent fashion in order to minimize the amount of applied lubricant composition. It has been discovered that the present invention may be applied intermittently and maintain a low coefficient of friction in between applications, or avoid a condition known as "drying". Specifically, the present invention may be applied for a period of time and then not applied for at least 15 minutes, at least 30 minutes, or at least 120 minutes or longer. The application period may be long enough to spread the composition over the conveyor belt (i.e. one revolution of the conveyor belt). During the application period, the actual application may be continuous, i.e. lubricant is applied to the entire conveyor, or intermittent, i.e. lubricant is applied in bands and the containers spread the lubricant around. The lubricant is preferably applied to the conveyor surface at a location that is not populated by packages or containers. For example, it is preferable to apply the lubricant spray upstream of the package or container flow or on the inverted conveyor surface moving underneath and upstream of the container or package.

In some embodiments, the ratio of application time to non-application time may be 1:10, 1:30, 1:180, and 1:500 where the lubricant maintains a low coefficient of friction in between lubricant applications.

In some embodiments, the lubricant maintains a coefficient of friction below about 0.2, below about 0.15, and below about 0.12.

In some embodiments, a feedback loop may be used to determine when the coefficient of friction reaches an unacceptably high level. The feedback loop may trigger the lubricant composition to turn on for a period of time and then optionally turn the lubricant composition off when the coefficient of friction returns to an acceptable level.

The lubricant coating thickness preferably is maintained generally at the interface at at least about 0.0001 mm, more preferably about 0.001 to about 2 mm, and most preferably about 0.005 to about 0.5 mm.

Application of the lubricant composition can be carried out using any suitable technique including spraying, wiping, brushing, drip coating, roll coating, and other methods for application of a thin film.

EXAMPLES

The invention can be better understood by reviewing the following examples. The examples are for illustration purposes only, and do not limit the scope of the invention.

Some of the following examples used a Slider Lubricity Test. The Slider Lubricity Test was done by measuring the drag force (frictional force) of a weighted cylinder package riding on a rotating disc wetted by the test sample. The bottom of the cylinder package was mild steel, glass, or PET and the rotating disc was stainless steel or delrin (plastic). The disc had a diameter of 8 inches and the rotation speed was typically 30 rpm. The drag force, using an average value, was measured with a solid state transducer, which was connected to the cylinder by a thin monofilament fishing line. The drag force was monitored with a strip chart recorder. The coefficient of friction (COF) was calculated by dividing the drag force (F) by the weight of the cylinder package (W): COF=F/W.

Three to five milliliters of the lubricant sample were applied with a disposable pipette onto the rotating track. The typical time for the test lubricant to reach a steady state was about 5-10 minutes. During this time, the liquid lubricant film on the track was replenished as needed. The average force for the last 1 minute (after the lubricant reached a steady state) was used as the final drag force for the "wet" mode. To continue with the "dry" mode test, the liquid lubricant was not replenished. As the liquid lubricant film continued to dry with time, the drag force changed in different ways depending on the type of lubricant. The "dry" mode COF was determined when the applied liquid film appeared dry by visual inspection and confirmed by gentle touching of the track. The drying time was about 10 to 30 minutes.

Example 1

Example 1 tested, as a control, the ability of a silicone based "dry lubricant" for PET containers to lubricate glass bottles on a stainless steel conveyor. For this example, the formula in Table 1 was used.

TABLE 1

| Silicone Based Lubricant Formula | |
|---|---|
| Polydimethylsiloxane | 5 wt. % |
| Polyoxypropylene polyoxyethylene block copolymer | 0.3 wt. % |
| Methyl paraben | 0.2 wt. % |
| Water | Balance |

The silicone based lubricant was tested using the Slider Lubricity Test. The silicone based lubricant was tested using PET cylinder on a delrin slider and a glass cylinder on a metal slider. The results are shown in Table 2.

TABLE 2

| Coefficient of Friction of the Silicone Based Lubricant Formula | | |
|---|---|---|
| | Coefficient of Friction | |
| | Wet | Dry |
| PET on Plastic | 0.129 | 0.131 |
| Glass on Metal | 0.302 | 0.219 |

The silicone based lubricant was effective at lubricating a PET cylinder on a plastic surface and produced acceptable coefficients of friction below 0.2 and specifically 0.129 and 0.131 when run in the wet and dry modes respectively. However, the silicone based lubricant was not effective at lubricating glass on a metal surface and produced coefficients of friction above 0.2, and specifically 0.302 and 0.219 when run in the wet and dry modes respectively. This is consistent with what has been observed in the field and what the formulas of the present invention are trying to overcome.

Example 2

It has been observed in the field that traditional glass and metal lubricants do not work well (i.e. do not produce an acceptable low coefficient of friction) when run in a dry mode, that is when applied for a period of time, and then turned off for a period of time while containers and packages continue to be moved along the conveyor surface. Example 2 tested, as a control, the ability of traditional glass and metal lubricants to work in a "dry mode." This example used Lubodrive RX™, a phosphate ester based lubricant, commercially available from Ecolab Inc., St. Paul, Minn., and Lubodrive TK™, a fatty amine based lubricant, commercially available from Ecolab Inc., St. Paul, Minn. This example tested 0.1% and 10% solutions of Lubodrive RX™ and Lubodrive TK™ in water. Lubodrive RX™ and Lubodrive TK™ are typically used at 0.1% concentrations. For this example, Lubodrive RX™ and Lubodrive TK™ were tested using the Slider Lubricity Test using a glass cylinder on a metal slider. The results are shown in Table 3.

TABLE 3

| Coefficient of Friction of Lubodrive TX ™ and Lubodrive TK ™ | | |
|---|---|---|
| | Coefficient of Friction | |
| | Wet | Dry |
| Lubodrive RX ™ 0.1% | 0.112 | 0.282 |
| Lubodrive TK ™ 0.1% | 0.127 | 0.190 |
| Lubodrive RX ™ 10% | 0.102 | 0.277 |
| Lubodrive TK ™ 10% | 0.097 | 0.258 |

Table 3 shows that traditional glass lubricants do not work well in a "dry" mode even when the concentration was raised to a hundred times that of the typical use level of 0.1%. Lubodrive RX™ and Lubodrive TK™ produced very acceptable coefficients of friction below 0.15 when used in the "wet" mode. However, when applied in a "dry" mode the coefficient of friction went above 0.2 in three cases, and 0.190 in a fourth case, even when the concentration was increased a hundred times the typical use level. These coefficients of friction are unacceptable in the industry.

Example 3

Example 3 tested the fatty acid formula of the present invention compared to the silicone control of Example 1 and the glass lubricants of Example 2. Specifically, Example 3 tested the impact of adding 1% fatty acid (oleic acid) to the silicone based lubricant of Table 1 and running the lubricant wet and dry. For this example, a premix solution of neutralized oleic acid was prepared by adding 100 grams of triethanolamine and 100 grams of oleic acid to 800 grams of deionized water. A lubricant solution was prepared by adding 50 grams of silicone emulsion (E2140FG, commercially available from Lambent Technologies Inc.), 3 grams of polyoxypropylene polyoxyethylene block copolymer (Pluronic F-108, commercially available from BASF, Mount Olive, N.J.), 2 grams of methyl paraben, and 100 grams of the premix solution of neutralized oleic acid to 845 grams of deionized water. Example 3 was tested using the Slider Lubricity Test and tested a PET cylinder on a plastic slider and a glass cylinder on a metal slider. The results are shown in Table 4.

TABLE 4

Coefficient of Friction of Silicone Based Lubricant Plus 1% Oleic Acid

| | Coefficient of Friction | |
|---|---|---|
| | Wet | Dry |
| Silicone Based Lubricant Plus 1% Oleic Acid (Present Invention) | | |
| PET on Plastic | 0.127 | 0.133 |
| Glass on Metal | 0.102 | 0.185 |

The mixture of the silicone based lubricant plus 1% oleic acid improved the glass on metal lubricity of the silicone based lube (see Table 2 control), wet or dry, while maintaining a good coefficient of friction for PET on a plastic surface when compared to the silicone based lube and the traditional glass lubricants (see Table 2 and Table 3 controls). In all cases, the coefficient of friction for the present invention remained below 0.2.

Example 4

Example 4 tested the phosphate ester formula of the present invention compared to the silicone based lubricant control of Table 1. Specifically, Example 4 tested the impact of adding 1% phosphate ester to the silicone based lubricant of Table 1, and running the lubricant wet or dry. For this example, a premix solution of neutralized phosphate ester was prepared by adding 2 grams of a 50% aqueous solution of sodium hydroxide and 10 grams of Rhodafac RA-600 phosphate ester (available from Rhodia, Cranbury, N.J.) to 88 grams of deionized water. A lubricant solution was prepared by adding 50 grams of silicone emulsion (E2140FG, commercially available from Lambent Technologies Inc.), 3 grams of polyoxypropylene polyoxyethylene block copolymer (Pluronic F-108, commercially available from BASF, Mount Olive, N.J.), 2 grams of methyl paraben, and 100 grams of the premix solution of neutralized phosphate ester to 845 grams of deionized water. For this example, the Slider Lubricity Test was used and tested PET on a plastic slider and glass on a metal slider. The results are shown in Table 5.

TABLE 5

Coefficient of Friction of Silicone Based Lubricant Plus 1% Phosphate Ester

| | Coefficient of Friction | |
|---|---|---|
| | Wet | Dry |
| Silicone Based Lubricant Plus 1% Phosphate Ester (Present Invention) | | |
| PET on Plastic | 0.119 | 0.113 |
| Glass on Metal | 0.107 | 0.156 |

The mixture of the silicone based lubricant with 1% phosphate ester improved the glass on metal lubricity of the silicone based lubricant (see Table 2 control), and improved the PET lubricity of the silicone based lubricant, wet or dry (see Table 2 and Table 3 controls). In all cases, the coefficient of friction for the present invention remained below 0.2 and at or below the very acceptable coefficient of friction of 0.15.

Example 5

Example 5 tested the amine acetate formula of the present invention, compared to the silicone based lubricant control of Table 1. Specifically, Example 5 tested the impact of adding 1% amine acetate to the silicone based lubricant. For this example, a premix solution of acidified fatty amine was prepared by adding 38.6 grams of glacial acetic acid, 75 grams of Duomeen OL (available from Akzo Nobel Surface Chemistry LLC, Chicago Ill.), and 30 grams of Duomeen CD (also available from Akzo Nobel), to 856.4 grams of deionized water. A lubricant solution was prepared by adding 50 grams of silicone emulsion (E2140FG, commercially available from Lambent Technologies Inc.), 3 grams of polyoxypropylene polyoxyethylene block copolymer (Pluronic F-108, commercially available from BASF, Mount Olive, N.J.), 2 grams of methyl paraben, and 100 grams of the premix solution of acidified fatty amine to 845 grams of deionized water. For this test, the Slider Lubricity Test was used and tested PET on a plastic slider and glass on a metal slider. The results are shown in Table 6.

TABLE 6

Coefficient of Friction of Silicone Based Lubricant Plus 1% Amine Acetate

| | Coefficient of Friction | |
|---|---|---|
| | Wet | Dry |
| Silicone Based Lubricant Plus 1% Amine Acetate (Present Invention) | | |
| PET on Plastic | 0.123 | 0.113 |
| Glass on Metal | 0.092 | 0.165 |

The mixture of the silicone based lubricant with 1% amine acetate improved the glass on metal lubricity of the silicone based lubricant (see Table 2 control), wet or dry, and improved the PET lubricity of the silicone based lubricant (see Table 2 and Table 3 controls). In all cases, the coefficient of friction of the present invention remained below 0.2.

Example 6

Example 6 tested the impact of intermittent lubricant application on the coefficient of friction. For this example, a solution of acidified oleyl propylene diamine was prepared by adding 10.0 g of Duomeen OL (available from Akzo Nobel Surface Chemistry LLC, Chicago Ill.) to 90.0 g of stirring deionized water. The resulting nonhomogeneous solution was acidified with glacial acetic acid until the pH was between 6.0 and 7.0 and the solution was clear. A "dry" lubricant solution was prepared by adding 5.0 g of Lambent 2140FG silicone emulsion, 5.0 g of the solution of acidified oleyl propylene diamine and 0.5 g of Huntsman Surfonic TDA-9 to 89.5 g of deionized water. The lubricant solution contained 97.5% water by weight. A conveyor system employing a motor-driven 83 mm wide by 6.1 meter long stainless steel conveyor belt is operated at a belt speed of 12 meters/minute. Twenty 12 ounce filled glass beverage bottles are stacked in an open-bottomed rack and allowed to rest on the moving belt. The total weight of the rack and bottles is 17.0 Kg. The rack is held in position on the belt by a wire affixed to a stationary strain gauge. The force exerted on the strain gauge during belt operation is recorded using a computer. Lubricant solution is applied to the conveyor by hand using a spray bottle for approximately one minute after the entire surface of the conveyor is visibly wet. The minimum value of coefficient of friction during the experiment was calculated by dividing minimum force acting on the strain gauge during the experiment by the weight of the bottles and rack and was determined to be 0.06. The coefficient of friction of the bottles on the track was likewise determined to be 0.09 at 30 minutes after the lubricant spray was applied and 0.13 at 90 minutes after the lubricant spray was applied. This example shows that a process of spraying a "dry" lubricant composition onto a conveyor track using a conventional spray bottle for a period of slightly greater than one revolution of the belt followed by 90 minutes of not dispensing any additional lubricant is effective to maintain a useful level of coefficient of friction less than 0.20.

Various modifications and alterations of this invention will be apparent to those skilled in the art without departing from the scope and spirit of the invention, and are intended to be within the scope of the following claims.

What is claimed is:

1. A method for lubricating the passage of a container along a conveyor, comprising applying an undiluted lubricant composition through non-energized nozzles to at least a portion of the container-contacting surface of the conveyor or to at least a portion of the conveyor-contacting surface of the container, the lubricant composition comprising:

a. from about 0.05 to about 20 wt. % of a fatty acid;

b. from about 0.1 to about 10 wt. % of a water-miscible silicone material; and c. from about 70 to about 99.9 wt. % water.

2. The method of claim 1, wherein the silicone material comprises a silicone emulsion, finely divided silicone powder, or silicone surfactant.

3. The method of claim 1, wherein the fatty acid is selected from the group consisting of oleic acid, tall oil, coconut oil, and mixtures thereof.

4. The method of claim 1, wherein the mixture has a total alkalinity equivalent to less than about 100 ppm $CaCO_3$.

5. The method according to claim 4, wherein the total alkalinity equivalent is less than about 30 ppm $CaCO_3$.

6. The method according to claim 1, wherein the composition maintains a coefficient of friction of less than about 0.2 over the entire period of use.

7. The method of claim 6, wherein the coefficient to friction is less than about 0.15.

8. The method of claim 1, wherein the container is selected from the group consisting of polyethylene terephthalate, polyethylene naphthalate, glass, and metal.

9. The method of claim 1, wherein the composition is applied only to those portions of the conveyor that will contact the containers, or only to those portions of the containers that will contact the conveyor.

10. The method of claim 1, wherein the composition is diluted prior to applying the lubricant to at least a portion of the container-contacting surface of the conveyor or to at least a portion of the conveyor-contacting surface of the container.

11. A method for lubricating the passage of a container along a conveyor, comprising applying an undiluted lubricant composition through non-energized nozzles to at least a portion of the container-contacting surface of the conveyor or to at least a portion of the conveyor-contacting surface of the container, the lubricant composition comprising:

a. from about 0.05 to about 20 wt.% phosphate ester;

b. from about 0.1 to about 10 wt. % of a water-miscible silicone material; and c. from about 70 to about 99.9 wt. % water.

12. The method of claim 11, wherein the silicone material comprises a silicone emulsion, finely divided silicone powder, or silicone surfactant.

13. The method of claim 11, wherein the phosphate ester comprises polyethylene phenol ether phosphate.

14. The method of claim 11, wherein the mixture has a total of the alkalinity equivalent to less than about 100 ppm $CaCO_3$.

15. The method according to claim 14, wherein the total alkalinity equivalent is less than about 30 ppm $CaCO_3$.

16. The method according to claim 11, wherein the composition maintains a coefficient of friction of less than about 0.2 over the entire period of use.

17. The method of claim 16, wherein the coefficient to friction is less than about 0.15.

18. The method of claim 11, wherein the container is selected from the group consisting of polyethylene terephthalate, polyethylene naphthalate, glass, and metal.

19. The method of claim 11, wherein the composition is applied only to those portions of the conveyor that will contact the containers, or only to those portions of the containers that will contact the conveyor.

20. The method of claim 11, wherein the composition is diluted prior to applying the lubricant to at least a portion of the container-contacting surface of the conveyor or to at least a portion of the conveyor-contacting surface of the container.

21. A method for lubricating the passage of a container along a conveyor, comprising applying an undiluted lubricant composition though non-energized nozzles to at least a portion of the container-contacting surface of the conveyor or to at least a portion of the conveyor-contacting surface of the container, the lubricant composition comprising:

a. from about 0.05 to about 20 wt. % of an amine;

b. from about 0.1 to about 10 wt. % of a water-miscible silicone material; and c. from about 70 to about 99.9 wt. % water.

22. The method of claim 21, wherein the silicone material comprises a silicone emulsion, finely divided silicone powder, or silicone surfactant.

23. The method of claim 21, wherein the amine is selected from the group consisting of oleyl diamino propane, coco diamino propane, lauryl propyl diamine, dimethyl lauryl amine, PEG coco amine, alkyl C12-C14 oxy propyl diamine, and mixtures thereof.

24. The method of claim 21, wherein the mixture has a total of the alkalinity equivalent to less than about 100 ppm $CaCO_3$.

25. The method according to claim 24, wherein the total alkalinity equivalent is less than about 30 ppm $CaCO_3$.

26. The method according to claim 21, wherein the composition maintains a coefficient of friction of less than about 0.2 over the entire period of use.

27. The method of claim 26, wherein the coefficient to friction is less than about 0.15.

28. The method of claim 21, wherein the container is selected from the group consisting of polyethylene terephthalate, polyethylene naphthalate, glass, and metal.

29. The method of claim 21, wherein the composition is applied only to those portions of the conveyor that will contact the containers, or only to those portions of the containers that will contact the conveyor.

30. The method of claim 21, wherein the composition is diluted prior to applying the lubricant to at least a portion of the container-contacting surface of the conveyor or to at least a portion of the conveyor-contacting surface of the container.

31. A method for lubricating the passage of a container along a conveyor comprising applying an undiluted lubricant composition through non-energized nozzles to at least a portion of the container-contacting surface of the conveyor or at least a portion of the conveyor-contacting surface of the container, the undiluted lubricant composition comprising a mixture of a water-miscible silicone material and a water-miscible lubricant, wherein the lubricant composition is applied for a period of time and not applied for a period of time and the ratio of applied:not applied time is at least 1:10.

32. The method of claim 31, wherein the ratio of applied: not applied time is at least 1:30.

33. The method of claim 31, wherein the ratio applied:not applied time is at least 1:180.

34. The method of claim 31, wherein the ratio of applied: not applied time is at least 1:500.

35. The method of claim 31, the lubricant composition further comprising at least 50% by weight water.

36. The method of claim 31, wherein the water-miscible lubricant is selected from the group consisting of a fatty acid, a phosphate ester, and amine, an amine derivative, and mixtures thereof.

37. The method of claim 31, wherein the lubricant composition maintains a coefficient of friction of less than about 0.2 over the entire period of use.

38. The method of claim 31, wherein the composition maintains a coefficient of friction of less than about 0.15 over the entire period of use.

39. The method of claim 31, wherein the composition maintains a coefficient of friction of less than about 0.12 over the entire period of use.

40. The method of claim 31, wherein the composition is diluted prior to applying the lubricant to at least a portion of the container-contacting surface of the conveyor or to at least a portion of the conveyor-contacting surface of the container.

41. A method for lubricating the passage of a container along a conveyor comprising applying an undiluted lubricant composition through non-energized nozzles to at least a portion of the containers-contacting surface of the conveyor or at least a portion of the conveyor-contacting surface of the containers, the undiluted lubricant composition comprising a water-miscible silicone material, wherein the lubricant composition is applied for a period of time and not applied for a period of time and the ratio of applied:not applied time is at least 1:10.

* * * * *

UNITED STATES PATENT AND TRADEMARK OFFICE

CERTIFICATE OF CORRECTION

PATENT NO. : 7,741,257 B2
APPLICATION NO. : 11/080000
DATED : June 22, 2010
INVENTOR(S) : Valencia Sil et al.

It is certified that error appears in the above-identified patent and that said Letters Patent is hereby corrected as shown below:

Col. 13, line 7, claim 36: "ester, and amine," should read --ester, an amine,--

Signed and Sealed this
Twenty-first Day of June, 2011

David J. Kappos

David J. Kappos
*Director of the United States Patent and Trademark Office*